US006326720B1

(12) United States Patent
Ito et al.

(10) Patent No.: US 6,326,720 B1
(45) Date of Patent: Dec. 4, 2001

(54) SPARK PLUG AND IGNITION SYSTEM FOR USE WITH INTERNAL COMBUSTION ENGINE

(75) Inventors: Shoichiro Ito, Gifui; Yoshihiro Matsubara, Mie, both of (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 09/398,900

(22) Filed: Sep. 20, 1999

(30) Foreign Application Priority Data

Sep. 22, 1998 (JP) ..... 10-268255

(51) Int. Cl.[7] ..... H01T 13/20
(52) U.S. Cl. ..... 313/141; 313/142
(58) Field of Search ..... 313/141, 142

(56) References Cited

U.S. PATENT DOCUMENTS

| | | | |
|---|---|---|---|
| 3,923,698 | 12/1975 | Kamigaito | 252/518 |
| 5,514,929 | 5/1996 | Kawamura | 313/141 |
| 5,793,793 | 8/1998 | Matsutani et al. | 313/141 |
| 5,869,921 | 2/1999 | Matsutani et al. | 313/141 |
| 6,262,522 * | 7/2001 | Osamura et al. | 313/141 |

FOREIGN PATENT DOCUMENTS

| | | |
|---|---|---|
| 0 817 342 A1 | 1/1998 | (EP) . |
| 0 866 530 A1 | 9/1998 | (EP) . |
| 2 302 867 A | 1/1997 | (GB) . |
| 63 058910 | 3/1988 | (JP) . |

* cited by examiner

*Primary Examiner*—Vip Patel
(74) *Attorney, Agent, or Firm*—Brinks Hofer Gilson & Lione

(57) ABSTRACT

A spark plug includes a spark portion of an Ir-based metal and a resistor disposed between a center electrode and a metallic terminal and adapted to establish an electric resistance of not less than 10 kΩ, preferably not less than 15 kΩ, but not greater than 25 kΩ as measured between the center electrode and the metallic terminal. Thus, even in a system in which an ignition coil is connected directly to the spark plug without use of a high tension cable, an electrical discharge with a relatively weak current, such as a glow discharge, can be maintained stably, so that even at high speed or heavy load operation, consumption of the spark portion caused by volatilization of Ir through oxidation can be suppressed, thereby extending spark plug life.

18 Claims, 13 Drawing Sheets

CENTER ELECTRODE: ϕ1.0, Ir ALLOY

PERCENT INDEX RELATIVE TO THE CASE WHERE GAP=0.8 mm ABD RESISTENCE = 5kΩ

CENTER ELECTRODE: φ1.0, Ir ALLOY

PERCENT INDEX RELATIVE TO THE CASE WHERE RESISTANCE OF DIL SYSTEM IS 5kΩ

SPARK PLUG AND IGNITION SYSTEM FOR USE WITH INTERNAL COMBUSTION ENGINE

BACKGROUND OF THE INVENTION

1. Field of the Invention

The present invention relates to a spark plug for use with an internal combustion engine and to an ignition system for use with an internal combustion engine having the spark plugs.

2. Description of the Related Art

Ignition systems used with automotive internal combustion engines having spark plugs have conventionally employed a distributor. In such ignition systems, an ignition coil includes a primary coil, which receives electricity from a battery via an ignition switch and is connected to an igniter and a secondary coil which is connected to a distributor. When an electronic control unit issues a break instruction signal to the igniter at a predetermined firing timing, the igniter causes a contactless switch unit to operate so as to interrupt current flowing to the primary coil. As a result, a high-voltage current is induced in the secondary coil. The distributor distributes the induced current to spark plugs through high-tension cables.

However, recently, the above-described distributor ignition system has been replaced by a full transistor type coil-on-plug ignition system (hereinafter referred to as a "DLI" (Distributor-Less Ignition system). The DLI system features easy control of ignition timing and does not require maintenance of contacts. In the DLI system, an ignition coil is mounted directly on each spark plug. A control unit interrupts current flowing to the primary coil of the ignition coil of each spark plug at a predetermined timing to thereby fire the spark plug. Since ignition coils are mounted directly on the respective spark plugs, high-tension cables are not required.

Conventionally, in order to improve resistance to spark consumption of a spark plug, a chip of Pt (platinum) serving as a spark portion is formed at one end of an electrode of the spark plug. However, since Pt is expensive and the melting point thereof is approximately 1769° C. indicating that resistance to spark consumption of Pt is insufficient, use of Ir (iridium), which has a melting point of approximately 2454° C., as material for the chip has been proposed. However, a spark portion of Ir produces a volatile oxide at a temperature of 900° C. to 1000° C., indicating a tendency to be consumed within this temperature range.

In a spark plug having a chip of an Ir-based material as a spark portion, employment of the above-mentioned DLI system may have a significantly adverse effect on durability of the spark portion. Specifically, spark discharge of a spark plug is generally classified, according to form, into glow discharge and arc discharge. A glow discharge occurs, for example, when the impedance of a power source (hereinafter referred to as a "power source impedance") is relatively high. Since a discharge current is relatively weak, the glow discharge causes a less severe temperature increase and less consumption of the spark portion. By contrast, an arc discharge often occurs when a power source impedance is relatively low. Accordingly, a strong discharge current tends to flow, causing a considerable temperature increase in the spark portion with a resultant advancement of consumption of the spark portion. Therefore, from the viewpoint of suppression of consumption of the spark portion, glow discharge is desirably dominant in a spark discharge.

In the distributor ignition system, the power source impedance is high because of the electric resistances of a contact gap and a high tension cable. Accordingly, glow discharge is dominant in a spark discharge. However, in the DLI system, the power source impedance is low, since the electric resistances of a contact gap and a high tension cable are not present. Accordingly, depending on the material used for an electrode, the rate of transition from glow discharge to arc discharge increases in a spark discharge, potentially causing consumption of the electrode. According to a study conducted by the inventors of the present invention, a spark portion of an Ir-based material exhibits a particularly high rate of transition from glow discharge to arc discharge, potentially shortening spark plug life. This tendency is further accelerated by consumption of the spark portion caused by volatilization through oxidation.

Further, Japanese Patent Application Laid-Open No. 7-50192 (U.S. Pat. No. 5,514,929) describes that when a spark plug with a tip mainly formed of Ir is used in a gas engine, the energy of induced discharge can be decreased by use of a resistor having a resistance not less than 50 kΩ but not greater than 200 kΩ. However, although such a gas engine would not have a problem in relation to ignitability even when the discharge energy decreases, a gasoline engine would have a problem in relation to ignitability when the discharge energy decreases.

SUMMARY OF THE INVENTION

A first object of the present invention is to provide a spark plug in which an arc discharge becomes unlikely to occur in spite of a spark portion being formed from an Ir-based metal, to thereby suppress consumption of an electrode and deterioration of ignitability.

A second object of the present invention is to provide an ignition system for use with an internal combustion engine having the spark plugs.

To achieve the first object, the present invention provides a spark plug comprising: a center electrode; an insulator which surrounds the center electrode; a metallic shell which surrounds the insulator; a ground electrode which faces the center electrode; and a spark portion which is fixedly attached to at least either one of the center electrode and the ground electrode to thereby define a spark discharge gap. The spark portion is formed from a metal which contains not less than 60% by weight Ir. The spark plug further comprises a metallic terminal fixedly attached into one end portion of a through-hole formed axially in the insulator, the center electrode being fixedly attached into the other end portion of the through-hole; and a resistor disposed within the through-hole and between the metallic terminal and the center electrode so as to establish an electric resistance of not less than 10 kΩ but not greater than 25 kΩ between the metallic terminal and the center electrode.

To achieve the second object, the present invention provides an ignition system for use with an internal combustion engine comprising a spark plug and a coil unit.

The spark plug comprises a center electrode; an insulator which surrounds the center electrode; a metallic shell which surrounds the insulator; a ground electrode which faces the center electrode; and a spark portion which is fixedly attached to at least either one of the center electrode and the ground electrode to thereby define a spark discharge gap. The spark portion is formed from a metal which contains not less than 60% by weight Ir. The spark plug further comprises a metallic terminal fixedly attached into one end portion of a through-hole formed axially in the insulator, the center electrode being fixedly attached into the other end portion of the through-hole.

The coil unit comprises a casing attached to the spark plug and an ignition coil accommodated within the casing and connected to the metallic terminal of the spark plug in order to apply a high voltage to the spark plug for effecting an electrical discharge.

The ignition system further comprises a resistance portion disposed between the ignition coil and the center electrode so as to establish an electric resistance of not less than 10 kΩ but not greater than 25 kΩ between the ignition coil and the center electrode.

When the spark portion is formed from an Ir-based metal, the metal must contain Ir in an amount of not less than 60% by weight. Otherwise, the high melting point of Ir fails to lead to sufficient improvement in resistance to spark consumption of the spark portion. However, as described previously, in the DLI system, a high Ir content of the spark portion tends to cause transition to a strong-current discharge, such as an arc discharge. As a result, the temperature of the spark portion increases to such a level that an Ir component volatilizes through oxidation, so that the spark portion is consumed accordingly.

The present inventors conducted extensive studies and, as a result, found that even in the DLI system a spark plug whose spark portion is of the above-described Ir-based metal (hereinafter referred to as an "Ir-type plug") stably maintains an electrical discharge with a relatively weak current, such as a glow discharge, through establishment of an electric resistance of not less than 10 kΩ (corresponding to a power source impedance) between the ignition coil and the center electrode. On the basis of this finding, the present invention has been achieved. Through establishment of such an electric resistance, even when the Ir-type plugs are employed in the DLI system, transition to a strong current discharge, such as an arc discharge, becomes unlikely to occur. Thus, even at high speed or heavy load operation, consumption of the spark portion caused by volatilization of Ir through oxidation can be suppressed, thereby extending spark plug life. Notably, electric resistance as measured between the ignition coil and the center electrode is preferably not less than 15 kΩ. However, if the electric resistance is in excess of 25 kΩ, ignitability may be impaired.

In order to establish an electric resistance of not less than 10 kΩ but not greater than 25 kΩ between the ignition coil and the center electrode, there may be utilized a resistor incorporated in a spark plug and adapted to reduce radio noise. In this case, the electric resistance of the resistor may be increased such that an electric resistance of not less than 10 kΩ (preferably not less than 15 kΩ) but not greater than 25 kΩ is established between the metallic terminal and the center electrode. When the resistor is not incorporated as in the case of an inexpensive, popular spark plug, a resistance portion, such as a resistor, may be provided in the coil unit such that an electric resistance of the above-mentioned range is established between the ignition coil and the center electrode.

In a spark plug, as the diameter of an end portion of the center electrode decreases, the volume of the end portion decreases. As a result, the end portion of the center electrode absorbs less heat from ignited flame, thereby improving ignitability. In the spark plug or ignition system of the present invention, in which the spark portion of the above-described Ir-based metal is formed at an end portion of the center electrode, the diameter of the end portion is preferably adjusted to not greater than 1.1 mm. By rendering the diameter of the end portion not greater than 1.1 mm, ignitability is improved significantly. More preferably, the diameter of the end portion is adjusted to 0.3 mm to 0.8 mm. By rendering the diameter of the end portion not greater than 0.8 mm, ignitability is further improved. When the diameter of the end portion becomes less than 0.3 mm, the temperature of the spark portion tends to increase due to spark concentration. As a result, the spark portion tends to be consumed due to volatilization of Ir through oxidation.

Generally, in a spark plug, the metallic shell surrounds the insulator. When the surface of the insulator becomes contaminated due to, for example, soot or fuel adhesion, a spark occurs between the inner surface of the metallic shell and the outer surface of the insulator, potentially hindering a normal generation of electrical discharge across a spark discharge gap. Decreasing the spark discharge gap is an effective way to maintain normal electrical discharge across the gap when the surface of the insulator becomes contaminated. In order to maintain resistance to contamination of the spark plug, the spark discharge gap is preferably set to not greater than 1.2 mm, more preferably not greater than 0.8 mm. In order to prevent the occurrence of a short circuit across the gap, the spark discharge gap is preferably set to not less than 0.3 mm.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE PREFERRED EMBODIMENTS

Embodiments of the present invention will next be described in detail with reference to the drawings.

Figure 1:
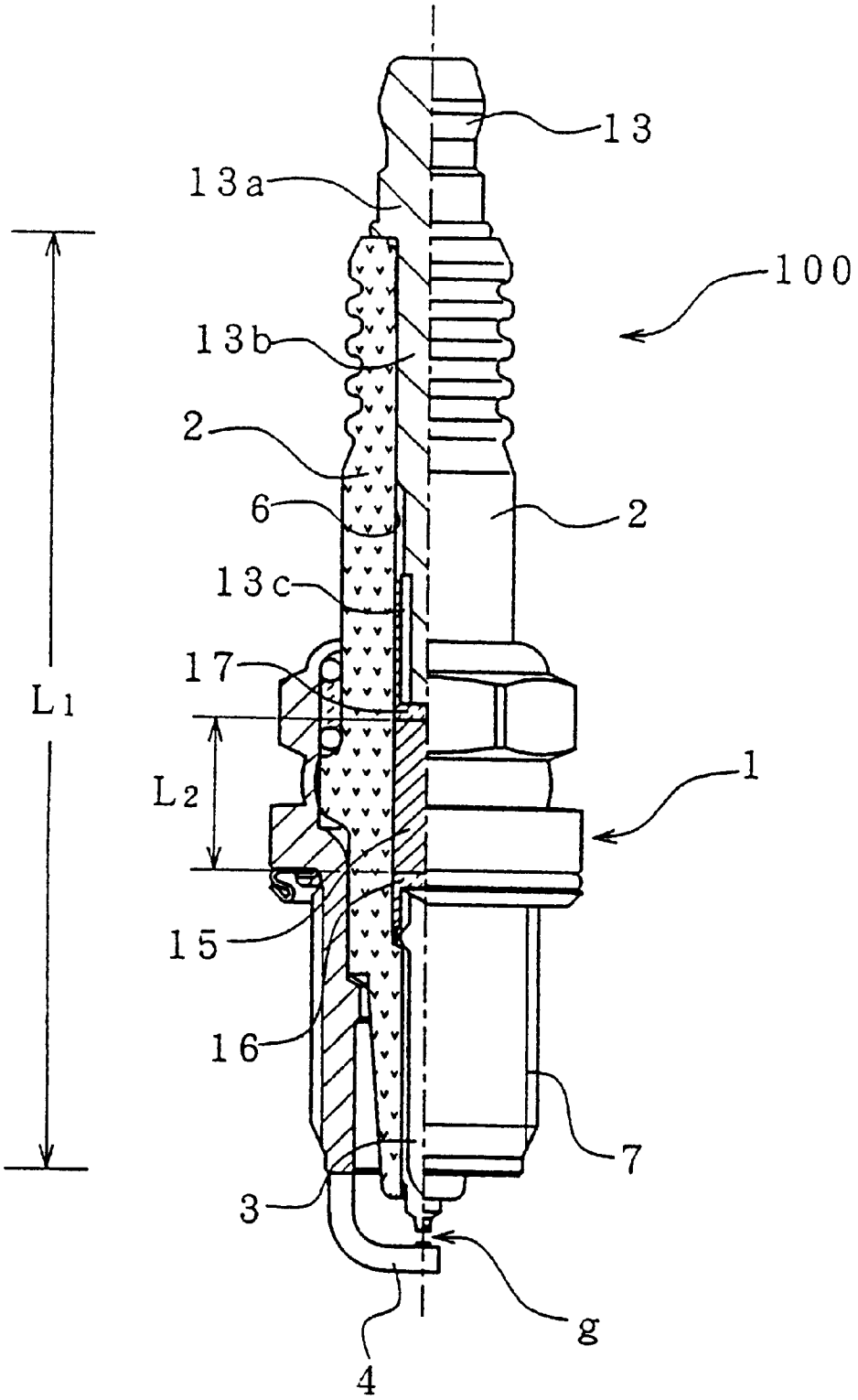
FIG. 1 is an elevational view in half section of a spark plug according to an embodiment of the present invention.
Figure 2:
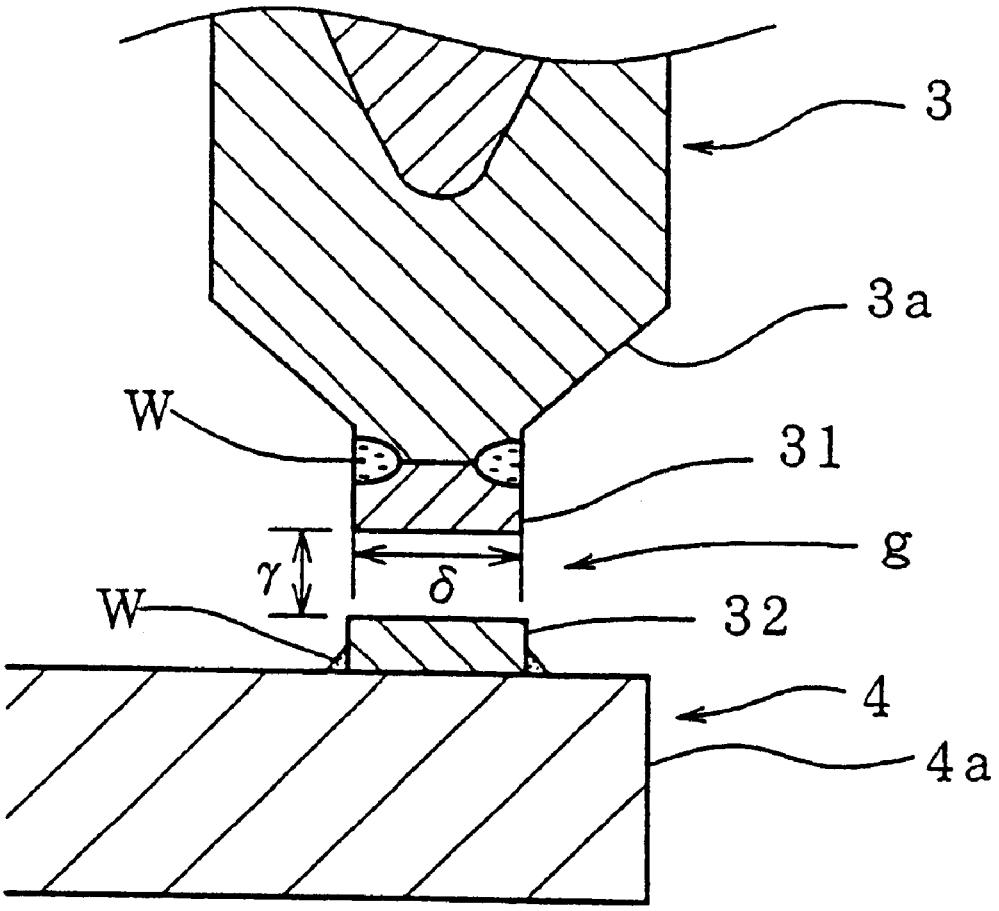
FIG. 2 is an enlarged, sectional view of portions of the spark plug of FIG. 1 located in the vicinity of a spark discharge gap.

FIG. 1 shows a spark plug 100, according to an embodiment of the present invention, into which a resistor is incorporated. The spark plug 100 includes a cylindrical metallic shell 1; an insulator 2, which is fitted into the metallic shell 1 such that a tip end portion projects from the metallic shell 1; a center electrode 3, which is provided within the insulator 2 such that a tip end projects from the insulator 2; and a ground electrode 4, which is disposed such that one end is connected to the metallic shell 1, and the other end faces the tip end of the center electrode 3. As shown in FIG. 2, a spark portion 32 is formed on the ground electrode 4 in such a manner as to face a spark portion 31 of the center electrode 3. The facing spark portions 31 and 32 define a spark discharge gap g therebetween.

The insulator 2 is formed from a ceramic sintered body, such as alumina or aluminum nitride. The metallic shell 1 is formed from, for example, low-carbon steel and serves as the housing of the spark plug 100. A screw portion 7 is formed on the outer surface of the metallic shell 1 and is adapted to attach the spark plug 100 to an engine block (not illustrated). The designation of the screw portion 7 is, for example, M14S. Length $L_1$ between an open end from which the center electrode 3 is projected and the rear end of the insulator 2 (the term "rear" refers to the upper side of FIG. 1) is, for example, 58.5 mm.

Body portions 3*a* and 4*a* (FIG. 2) of the center electrode 3 and the ground electrode 4, respectively, are formed from an Ni alloy (e.g., Inconel, Trademark). The spark portions 31 and 32 are formed from a metal that contains Ir in an amount of not less than 60% by weight.

As shown in FIG. 2, the body portion 3*a* of the center electrode 3 is tapered such that the diameter is decreased toward the tip end, and the face of the tip end is finished to a flat surface. A disk chip of an alloy, serving as the spark portion 31, is fixedly attached onto the end face of the body portion 3*a* through circumferential welding along the boundary between the disk chip and the body portion 3*a*. As a result of this welding, a weld zone W is formed along the boundary. Specific examples of this welding include laser welding, electron beam welding, and resistance welding. The spark portion 32 is formed in the following manner. A disk chip is positioned on the ground electrode 4 so as to be aligned with the facing spark portion 31. A weld zone W is formed along the boundary between the disk chip and the ground electrode 4 through welding as in the case of the spark portion 31, thereby fixedly attaching the disk chip onto the ground electrode 4. These chips may be formed from, for example, a fused material obtained by mixing components of an alloy in predetermined proportions and melting the resultant mixture, or a sintered material obtained by compacting and sintering an alloy powder or a mixture of powders of metal components of predetermined proportions.

Examples of alloy to be used as material for the above-mentioned chips are as follows:

(1) An alloy which contains Ir as a main component and Rh in an amount of 3% by weight to 40% by weight. Through use of this alloy, consumption of the spark portion, which would otherwise result from volatilization of Ir through oxidation at high temperature, is effectively suppressed, thereby realizing a spark plug having excellent durability.

When the Rh content of the alloy becomes less than 3% by weight, the effect of suppressing volatilization through oxidation of Ir becomes insufficient. As a result, the spark portion tends to be consumed, causing impairment in spark plug durability. When the Rh content of the alloy becomes 40% by weight or higher, the melting point of the alloy starts to decrease, with the result that in some cases, the durability of the spark plug starts to decrease. Thus, the Rh content of the alloy is 3% by weight to less than 50% by weight, preferably 7% by weight to 30% by weight, more preferably 15% by weight to 25% by weight, most preferably 18% by weight to 22% by weight.

(2) An alloy which contains Ir as a main component and Pt in an amount of 1% by weight to 20% by weight. Through use of this alloy, consumption of the spark portion, which would otherwise result from volatilization of Ir through oxidation at high temperature, is effectively suppressed, thereby realizing a spark plug having excellent durability. Notably, when the Pt content of the alloy becomes less than 1% by weight, the effect of suppressing volatilization through oxidation of Ir becomes insufficient. As a result, the spark portion tends to be consumed, causing impairment in spark plug durability. When the Pt content of the alloy becomes 20% by weight or higher, the melting point of the alloy lowers, causing impairment in spark plug durability.

A material for the chip (spark portion) may contain an oxide or composite oxide of a metallic element belonging to group 3A (so called rare earth metals) or group 4A (Ti, Zr, and Hf) of the periodic table in an amount of 0.1% by weight to 15% by weight. Through addition of such an oxide, consumption of the spark portion, which would otherwise result from volatilization of Ir through oxidation, is more effectively suppressed. Accordingly, when such an oxide is added to the material for the chip, a metallic component of the material may be elemental Ir, as well as the Ir alloy described above in (1) or (2). When the oxide content of the material is less than 0.1% by weight, the addition of such an oxide fails to sufficiently yield the effect of suppressing volatilization through oxidation of Ir. When the oxide content of the material is in excess of 15% by weight, resistance to thermal shock of the chip is impaired. As a result, when, for example, the chip is welded to the electrode, the chip may crack. Notably, $Y_2O_3$ is preferred as the above-mentioned oxide. Further, $La_2O_3$, $ThO_2$, or $ZrO_2$, for example, may also be preferred.

The diameter δ of the spark portion 31, i.e., the diameter δ of the end portion of the center electrode 3, is not greater than 1.1 mm, preferably 0.3 mm to 0.8 mm. A dimension γ of the spark discharge gap g is not greater than 1.2 mm, preferably 0.3 mm to 1.1 mm, more preferably 0.6 mm to 0.9 mm. Either the spark portion 31 or the spark portion 32 may be omitted. In this case, the spark discharge gap g is defined by the spark portion 31 and the ground electrode 4 or by the spark portion 32 and the center electrode 3.

Referring back to FIG. 1, in the spark plug 100, a through-hole 6 is formed axially in the insulator 2. A metallic terminal 13 is fixedly inserted into one end portion of the through-hole 6, while the center electrode 3 is fixedly inserted into the other end portion of the through-hole 6. A resistor 15 is disposed within the through-hole 6 and between the metallic terminal 13 and the center electrode 3. The opposite ends of the resistor 15 are connected to the center electrode 3 and the metallic terminal 13 via conductive glass seal layers 16 and 17, respectively.

The metallic terminal 13 is formed from, for example, low-carbon steel. An Ni plating layer (for example, 5 μm thick) is formed on the surface of the metallic terminal 13 to inhibit corrosion. The metallic terminal 13 includes a seal portion 13*c* (a tip end portion), a terminal portion 13*a* projected from the rear end of the insulator 2, and a bar portion 13*b* extending between the terminal portion 13*a* and the seal portion 13*c*. The seal portion 13*c* assumes an axially extending cylindrical form and is inserted into the conductive glass seal layer 17, so that the space between the seal portion 13*c* and the wall of the through-hole 6 is sealed by the seal layer 17.

The resistor 15 is fabricated by the steps of: mixing glass powder, ceramic powder, metal powder (which contains, as a main component, a metal selected singly or in combination from the group consisting of Zn, Sb, Sn, Ag, and Ni), nonmetallic conductive substance powder (for example, amorphous carbon (carbon black) or graphite), and an organic binder in predetermined proportions; and sintering the resulting mixture by a known method, for example, by use of a hot press. The composition and dimensions of the resistor 15 are adjusted so as to establish an electric resistance of not less than 10 kΩ (preferably not less than 15 kΩ) but not greater than 25 kΩ as measured between the metallic terminal 13 and the center electrode 3.

The conductive glass seal layers 16 and 17 are formed from glass mixed with metal powder, which contains, as a main component, metal selected singly or in combination from among metals including Cu and Fe. The metal content of the resulting mixture is 35% by weight to 70% by weight. Notably, the conductive glass seal layers 16 and 17 may contain semiconducting inorganic compound powder, such as $TiO_2$, in an appropriate amount.

Figure 3:
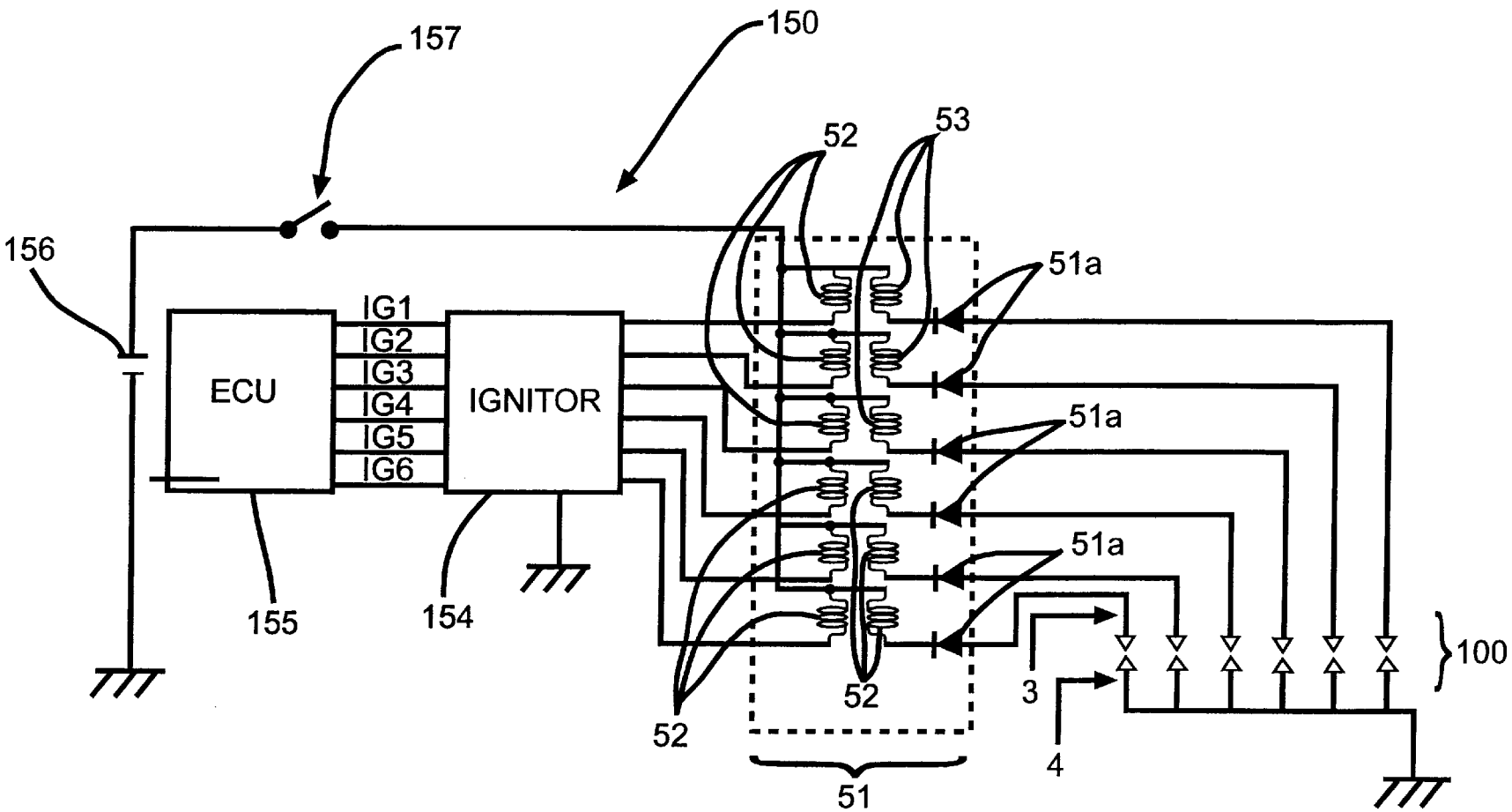
FIG. 3 is a circuit diagram showing an ignition system example employing the spark plugs of FIG. 1.

FIG. 3 shows an ignition system employing the spark plugs 100. As shown in FIG. 3, an ignition system 150 does not employ a distributor, but includes ignition coils 51 adapted to directly apply voltage to the corresponding spark plugs 100. Each of the ignition coils 51 includes a primary coil 52 adapted to receive electricity from a battery 156 and connected to an igniter 154. The ignition coil 51 further includes a secondary coil 53 connected to a corresponding one of the spark plugs 100. The igniter 154 includes contactless switches, such as transistors, corresponding to the ignition coils 51. Upon reception of a break instruction signal issued from the corresponding output port of an electronic control unit 155, each of the contactless switches comes into a broken or open state. A diode 51*a* is provided between each ignition coil 51 and each spark plug 100 in order to prevent re-electrification of the spark plug 100, which would otherwise occur when the corresponding contactless switch returns to a conducting state from the open state.

Figure 4:
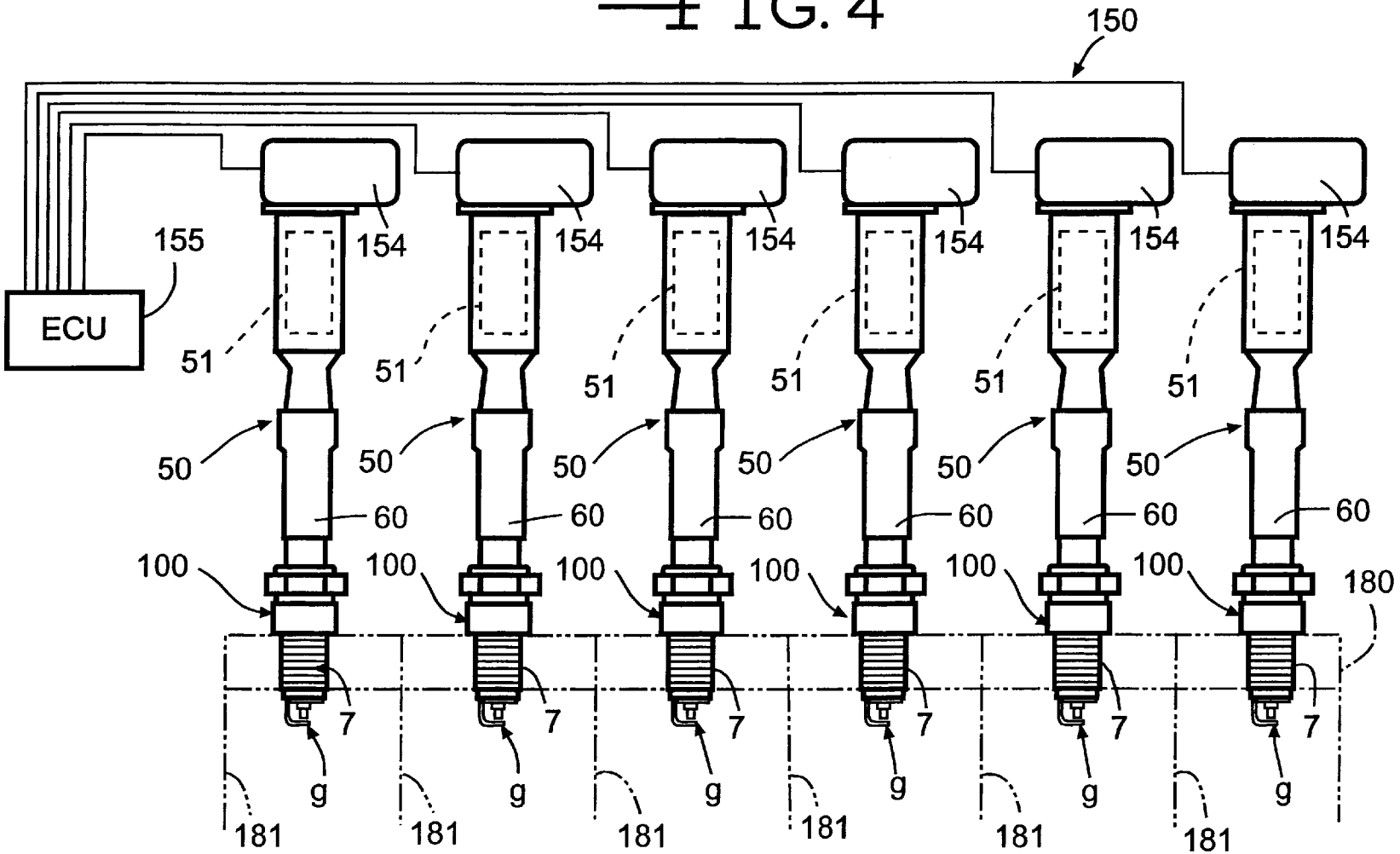
FIG. 4 is a schematic front view showing the ignition system of FIG. 3 mounted on an engine.

As shown in FIG. 4, when an internal combustion engine 180 assumes the form of a multiple-cylinder gasoline engine, the spark plug 100 is mounted, by means of the mounting screw portion 7, on each of the cylinders 181 such that the spark discharge gap g is located within a combustion chamber. Coil units 50 are attached to the spark plugs 100 in one-to-one correspondence and are connected to the electronic control unit 155. The coil unit 50 includes a casing 60 fitted to the rear end portion of the spark plug 100. The casing accommodates the ignition coil 51 and the igniter 154. The ignition coil 51 is electrically connected to the metallic terminal 13 of the spark plug 100 by means of an terminal portion (not-illustrated) of the coil unit 50.

In the spark plug 100, the resistor 15 may be omitted, and the metallic terminal 13 and the center electrode 3 may be connected by means of, for example, a single conductive glass seal layer. In the spark plug 100 provided with the resistor 15 and the conductive glass seal layer 16 disposed between the resistor 15 and the center electrode 3, the conductive glass seal layer 16 may be omitted. In this case, a resistor may be disposed, for example, between the ignition coil 51 and the terminal portion of the coil unit 50 so as to establish an electric resistance of not less than 10 kΩ (preferably not less than 15 kΩ) but not greater than 25 kΩ between the ignition coil 51 and the center electrode 3 of the spark plug 100.

EXAMPLE

In order to confirm the effect of the above-described spark plug 100 and ignition system 150, the following experiments were conducted. Fine glass powder (average grain size 80 μm; 30 parts by weight), $ZrO_2$ powder (average grain size 3 μm; 60 parts by weight) serving as ceramic powder, Al powder (average grain size 20 to 50 μm: 1 part by weight) serving as metal powder, carbon black (2 to 9 parts by weight) serving as nonmetallic conductive substance powder, and dextrin (3 parts by weight) serving as an organic binder were mixed. The resulting mixture was wet-milled in a ball mill while water was used as solvent. The resulting mixture was dried, obtaining a preliminary material. Coarse glass powder (average grain size 250 μm) was mixed with the preliminary material in an amount of 400 parts by weight per 100 parts by weight of the preliminary material, obtaining a resistor composition in the form of powder. A material for the glass powder was borosilicate lithium glass, which was obtained by the steps of mixing 50 parts by weight $SiO_2$, 29 parts by weight $B_2O_5$, 4 parts by weight $Li_2O$, and 17 parts by weight BaO and melting the resulting mixture and whose softening temperature was 585° C.

Next, the resistors 15 were formed from the resistor composition powder by use of a hot press. Through use of the resistor 15, there were manufactured various samples of the spark plug 100 of FIG. 1 into which the resistor 15 is incorporated. In the samples, the center electrode 3 was formed from an Ni alloy (Inconel 600) and had an axial length of 20.7 mm and a cross-sectional diameter of 2.6 mm. The diameter of the through-hole 6 formed in the insulator 2 (substantially identical to the cross-sectional diameter of the resistor 15) was 4.0 mm. Hot pressing was performed at a heating temperature of 900° C. and an applied pressure of 100 kg/cm$^2$. Conductive glass powder employed was a mixture of conductive powders of, for example, Cu, Fe, Sn, and $TiO_2$, and borosilicate calcium glass powder (the conductive powders are contained in an amount of approximately 50% by weight). In the obtained spark plug samples, the length L2 of the resistor 15 was 7.0 mm to 15.0 mm. The electric resistance $R_k$ as measured between the center electrode 3 and the metallic terminal 13 was adjusted to 5 kΩ to 30 kΩ through adjustment of the length L2 and composition of the resistor 15.

The spark portions 31 and 32 were fabricated in the following manner. Ir and Pt of predetermined amounts were mixed and melted, thereby obtaining an alloy which contains Pt in an amount of 5% by weight and Ir as the balance. The alloy was formed into disk chips having a diameter of 0.2 mm to 1.6 mm and a thickness of 0.6 mm. By use of the chips, the spark portions 31 and 32 of the spark plug 100 shown in FIGS. 1 and 2 were formed. In other words, spark plug samples having spark portions of various sizes ranging from 0.2 mm to 1.6 mm were fabricated. The spark discharge gap g was initially set to various values of γ ranging from 0.4 mm to 1.4 mm.

The thus-obtained spark plug samples were mounted on a 6 cylinder gasoline engine (engine capacity 1998 cc). The engine was continuously operated for up to 800 hours at an engine speed of 5600 rpm (at a center electrode temperature of approximately 780° C.) while throttles were completely open. After engine operation was halted, an increase in the spark discharge gap g was measured. The test employed the ignition system shown in FIG. 3. The ignition system effected an electrical discharge under the following conditions: the polarity of the center electrode was negative; the peak value of the secondary current was 70 mA; and the discharge energy was 65 mJ. During discharge, current and voltage waveforms were recorded by use of an oscilloscope. For comparison, a similar test was conducted by use of the distributor ignition system (DIS) shown in FIG. 11. In this case, the electric resistance as measured between the ignition coil 251 and the far end of each high-tension cable C was set to 5 kΩ to 10 kΩ.

Figure 5:
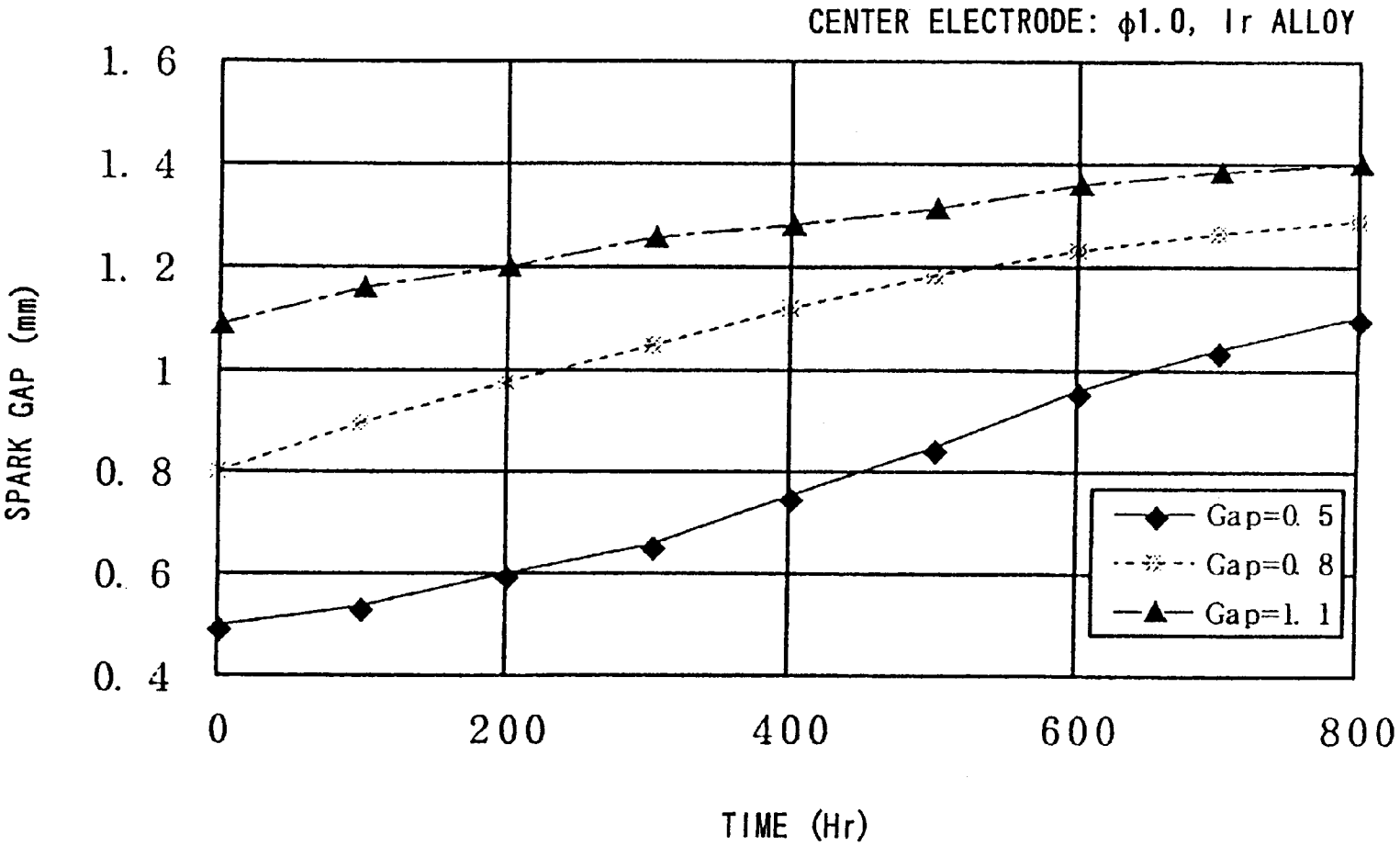
FIG. 5 is a graph showing the results of a test for a gap increasing behavior conducted on the spark plugs of FIG. 1.
Figure 6A:
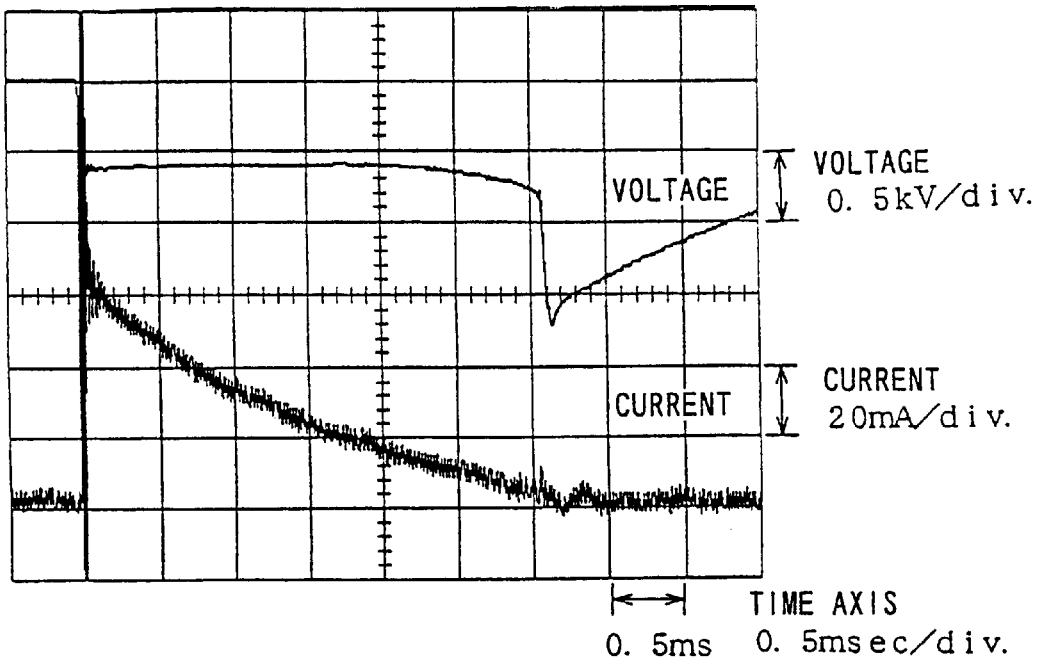
FIG. 6A is a graph showing the waveform of one electrical discharge.
Figure 6B:
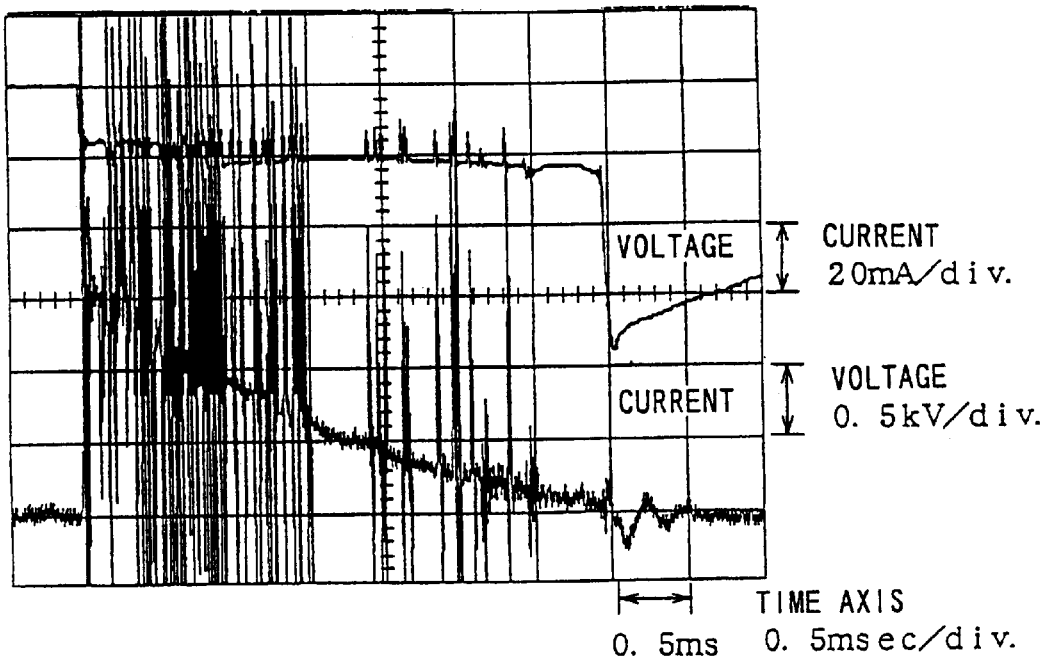
FIG. 6B is a graph showing the waveform of another electrical discharge.

FIG. 5 shows the results of a test for gap increasing behavior (i.e., electrode consumption). The test was conducted under the following conditions: the electric resistance Rk was 5 kΩ; the end diameter δ of the center electrode was 1.0 mm; and the initial spark discharge gap Y was 0.5, 0.8, and 1.1 mm. As seen from FIG. 5, spark plugs having an initial spark gap γ of 0.8 or 1.1 mm cause a large amount of electrode consumption, so that the gap increases considerably. Since it was considered that the form of an electrical discharge was responsible for a difference in gap increase, waveforms of discharge were observed. FIG. 6A shows the waveform of an electrical discharge at a γ value of 0.5 mm, and FIG. 6B shows the waveform of an electrical discharge at a γ value of 0.8 mm. In FIG. 6A, current shows a relatively stable behavior, implying that glow discharge is dominant. By contrast, in FIG. 6B, current frequently shows an abruptly increasing behavior, implying the occurrence of arc discharge. Particularly, it is conceivable that a strong current flows at the moment of transition from glow discharge to arc discharge. Conceivably, in the case of FIG. 6B, the frequency of transition from glow discharge to arc discharge within a single discharge cycle increases. Hence, an instantaneous flow of a strong current occurs frequently, resulting in a significant consumption of the electrode.

In FIG. 6A, in a region where glow discharge conceivably occurs, while the variation in the current falls within a range of 5 mA, the absolute value of current gradually decreases toward the end of a discharge cycle; i.e., a background current level is formed. In the present example, one discharge cycle is divided in 0.5 ms units and an average value in each division is calculated to thereby obtain the above-mentioned background current level. When current which is at least 20 mA greater than the obtained background current level flows, it is interpreted as transition from glow discharge to arc discharge. The number (frequency) of transitions within a single discharge cycle was counted to thereby evaluate transition susceptibility.

Figure 7:
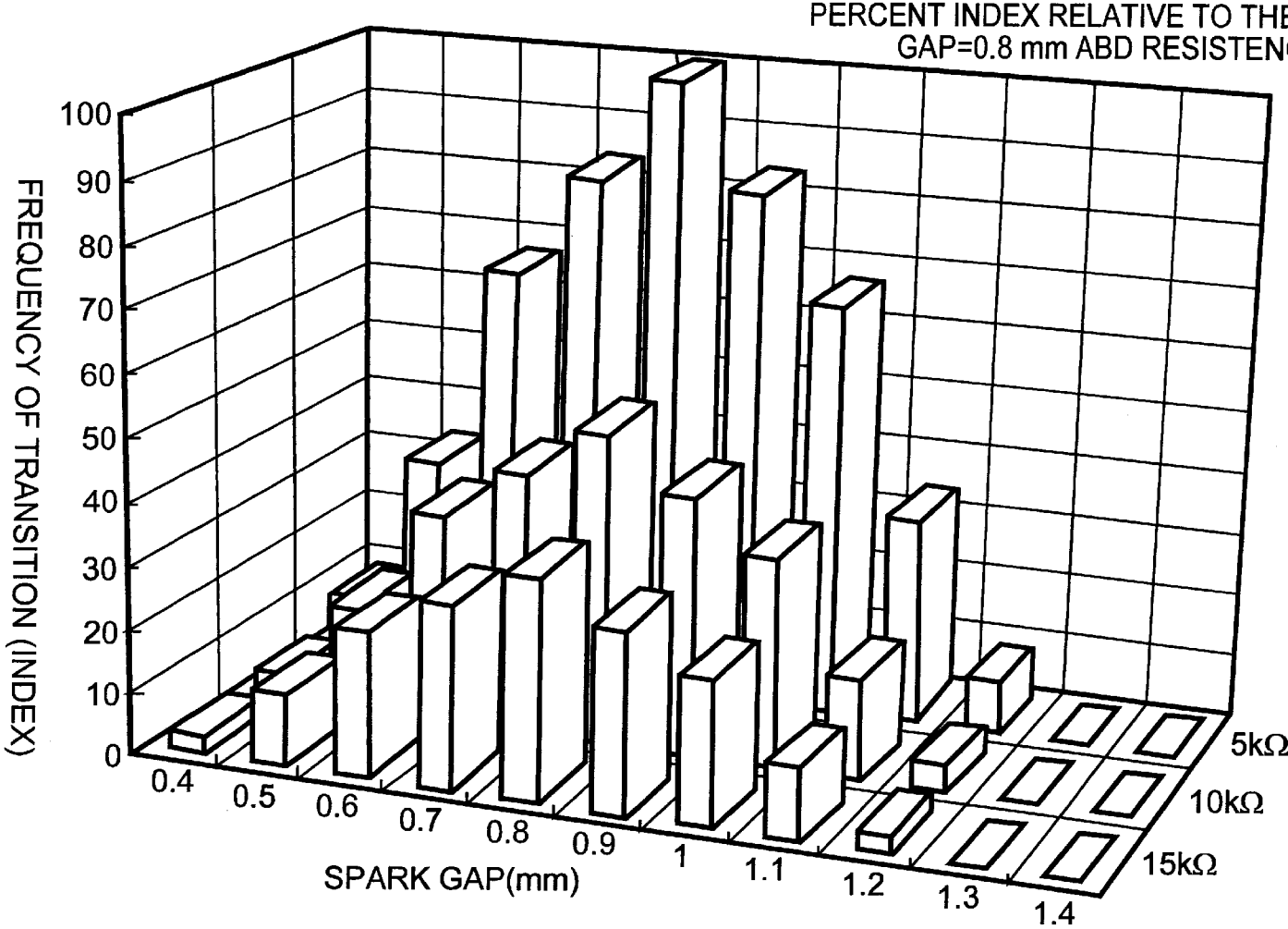
FIG. 7 is a graph showing the effects of spark gap and electric resistance on the frequency of transition from glow discharge to arc discharge.

FIG. 7 shows the results of a test in which the frequency of transition from glow discharge to arc discharge was measured while the electronic resistance $R_k$ and the initial spark discharge gap γ were changed. Specifically, a first group of spark plugs in which the end diameter δ of the center electrode was set to 1.0 mm and the electronic resistance $R_k$ was set to 5 kΩ were manufactured, while the initial spark discharge gap γ was changed in the range of 0.4 to 1.4 mm. A second group of spark plugs in which the end diameter δ of the center electrode was set to 1.0 mm and the electronic resistance $R_k$ was set to 10 kΩ were manufactured, while the initial spark discharge gap γ was changed in the range of 0.4 to 1.4 mm. Similarly, a third group of spark plugs in which the end diameter δ of the center electrode was set to 1.0 mm and the electronic resistance $R_k$ was set to 15 kΩ were manufactured, while the initial spark discharge gap γ was changed in the range of 0.4 to 1.4 mm. Subsequently, the frequency of transition from glow discharge to arc discharge was measured for each of the thus-manufactured spark plugs. In FIG. 7, the frequency of transition is represented in the form of an index when the frequency of transition as measured at a γ value of 0.8 mm and an $R_k$ value of 5 kΩ is taken as 100. Table 1 shows measurements.

TABLE 1

| Spark discharge gap | Frequency of transition (index) | | |
|---|---|---|---|
| (mm) | $R_k$ = 5 kΩ | $R_k$ = 10 kΩ | $R_k$ = 15Ω |
| 0.4 | 8 | 4 | 3 |
| 0.5 | 33 | 17 | 12 |
| 0.6 | 67 | 33 | 23 |
| 0.7 | 83 | 42 | 29 |
| 0.8 | 100 | 50 | 35 |
| 0.9 | 83 | 42 | 29 |
| 1.0 | 67 | 33 | 23 |
| 1.1 | 33 | 17 | 12 |
| 1.2 | 8 | 4 | 3 |
| 1.3 | 0 | 0 | 0 |
| 1.4 | 0 | 0 | 0 |

Figure 12:
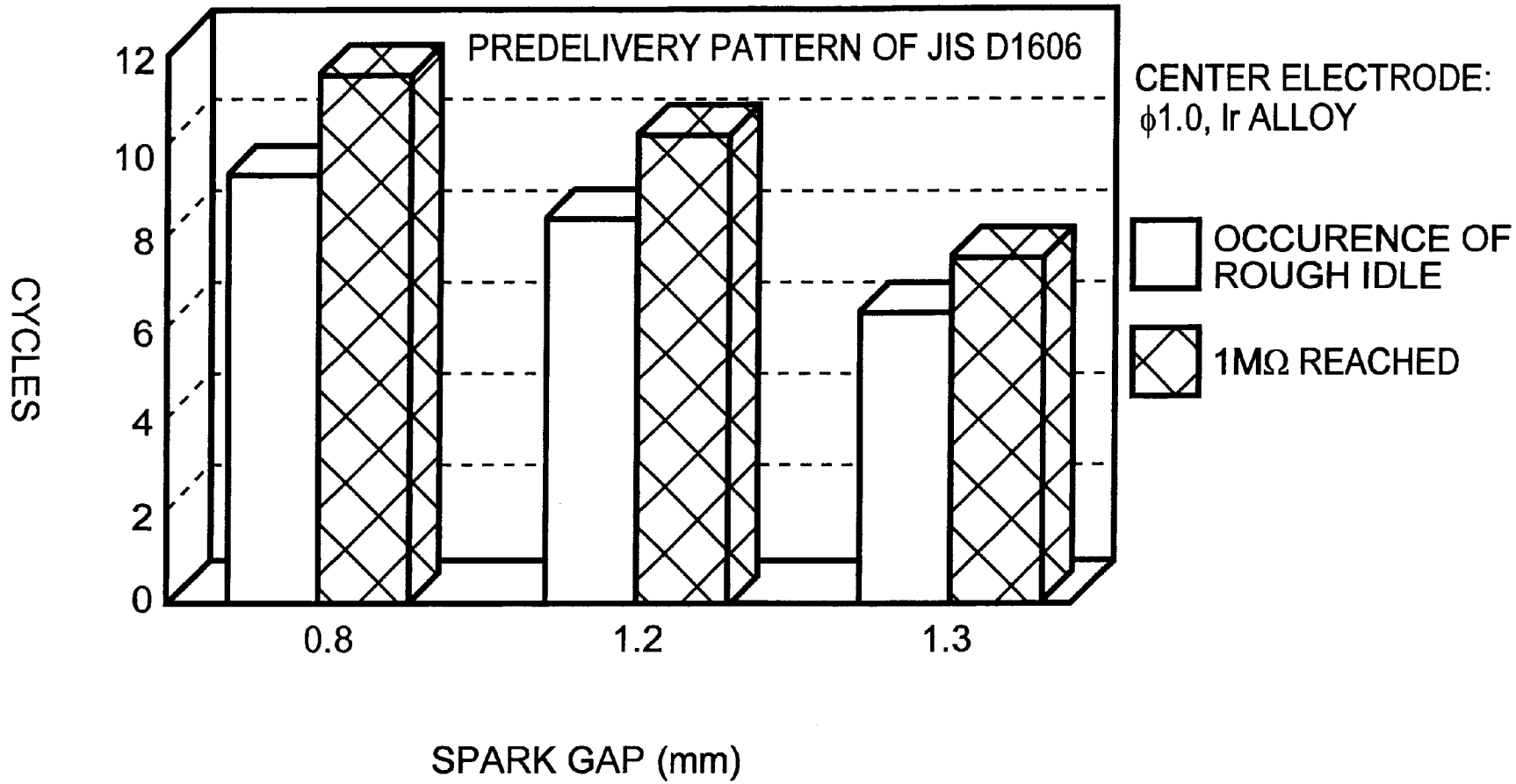
FIG. 12 is a graph showing the relationship between the number of durability cycles and a spark gap.

As seen from FIG. 7, as the electric resistance $R_k$ increases, the frequency of transition decreases. Meanwhile, in order to examine resistance to contamination of spark plugs, a predelivery durability test as specified in JIS D1606, was conducted on three groups of spark plugs, in which the first group of spark plugs were manufactured such that their electric resistances were set to 10 kΩ and their initial spark discharge gaps γ were set to 0.8 mm, the second group of spark plugs were manufactured such that their electric resistances were set to 10 kΩ and their initial spark discharge gaps γ were set to 1.2 mm and the third group of spark plugs were manufactured such that their electric resistances were set to 10 kΩ and their initial spark discharge gaps γ were set to 1.3 mm. The spark plugs were mounted on the engine of a test car and the test car underwent a test run. While a travelling pattern specified in JIS D1606 is taken as one cycle, there was counted the number of cycles until a rough idle occurred or until the insulation resistance of the spark plug sample decreased to 1 MΩ or less (the number of durability cycles). Resistance to contamination was evaluated in terms of the number of durability cycles. The test results are shown in FIG. 12. As seen from FIG. 12, when the value of γ exceeds 1.2 mm, the number of durability cycles begins to decrease, indicating impairment in resistance to contamination.

Figure 8:
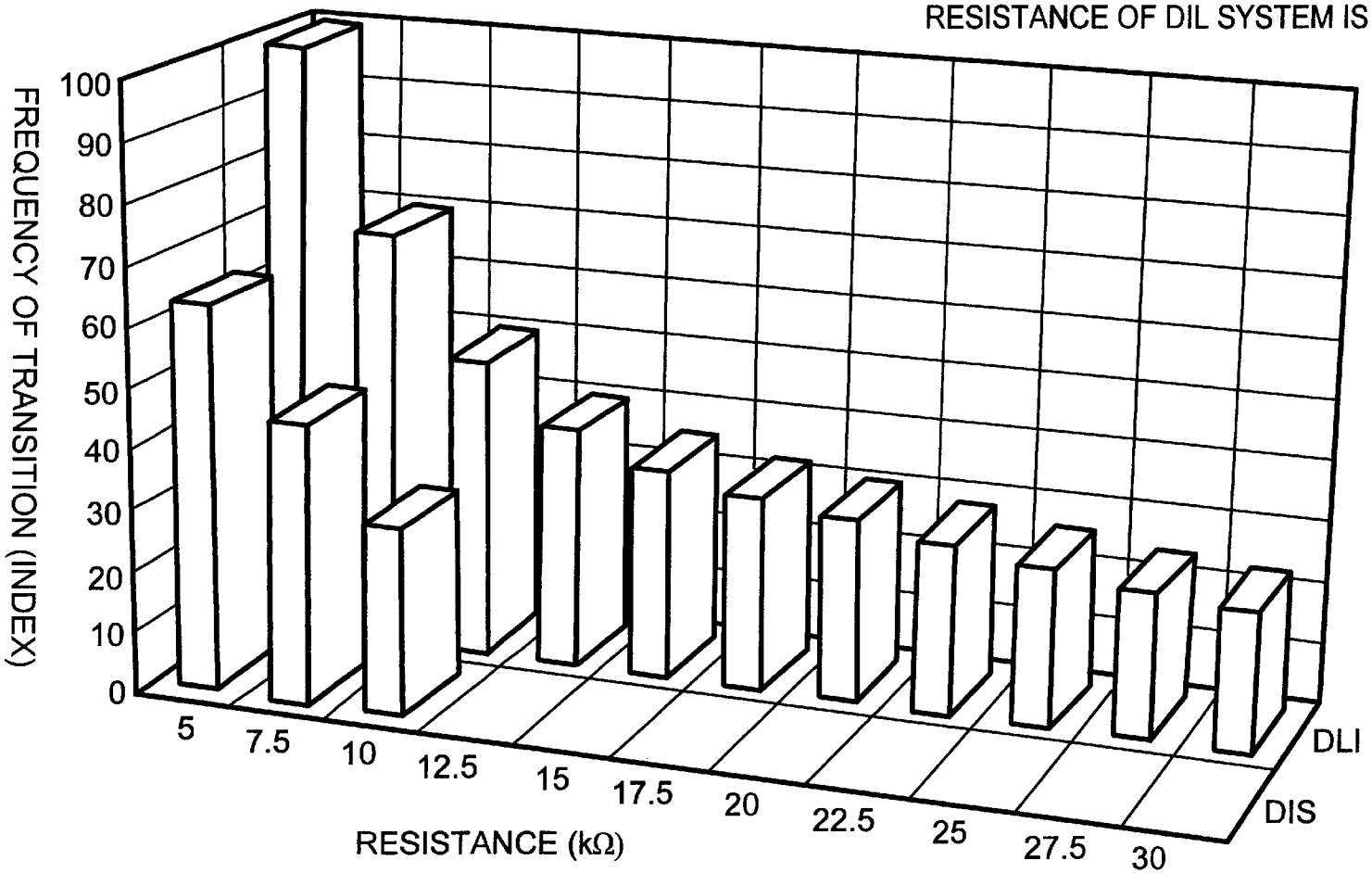
FIG. 8 is a graph showing the frequency of transition from glow discharge to arc discharge as measured with respect to the ignition system of FIG. 3 and an ignition system of FIG. 11.
Figure 11:
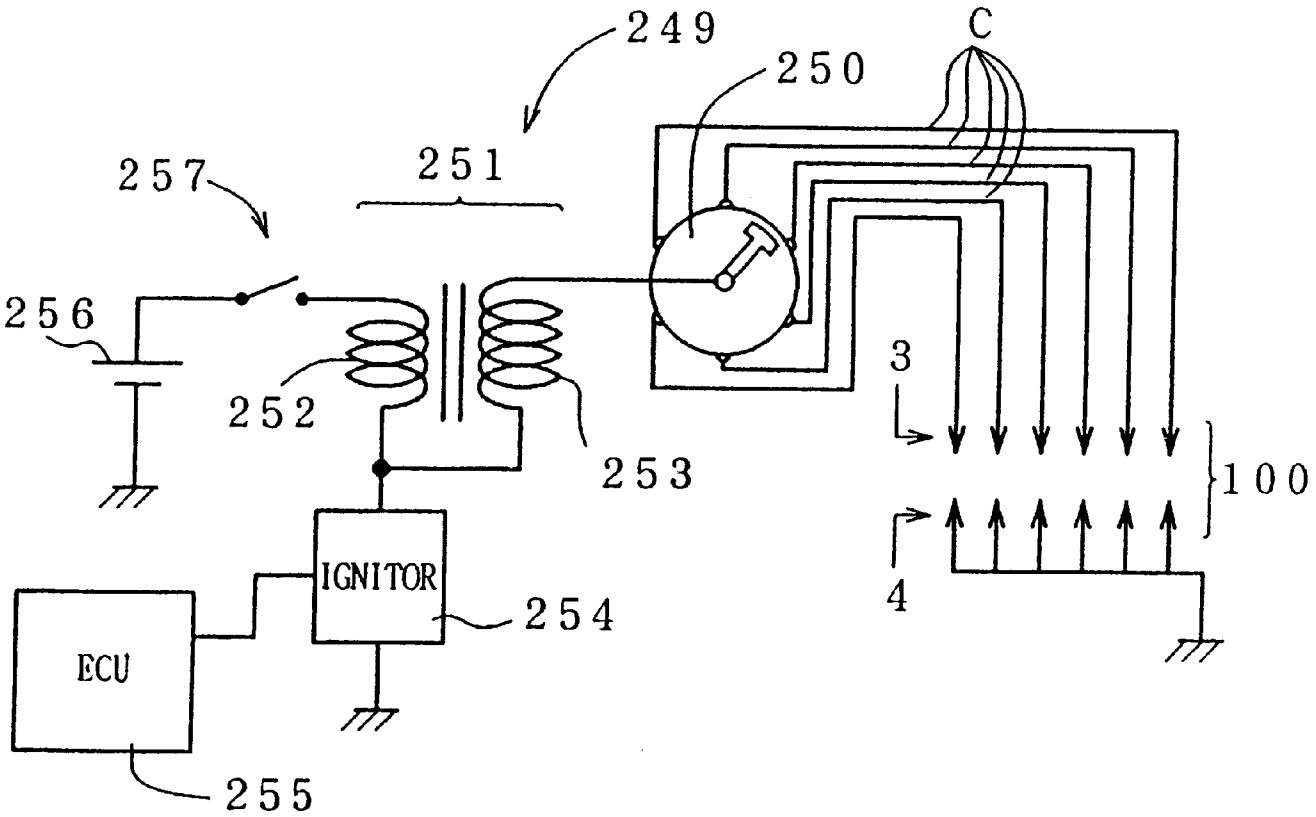
FIG. 11 (PRIOR ART)
FIG. 11 is a circuit diagram showing a distributor ignition system.

FIG. 8 shows results of a test performed for the DLI system of FIG. 3 and the DIS system of FIG. 11, in which the frequency of transition from glow discharge to arc discharge was measured while the electric resistance $R_k$ was changed. That is, for each of the DLI system of FIG. 3 and the DIS system of FIG. 11, spark plugs having initial spark discharge gap γ of 0.8 mm were manufactured such that the spark plugs had respective $R_k$ values within the range of 5 kΩ to 30 kΩ. The frequency of transition was measured for each of the thus-manufactured spark plugs. Table 2 shows measurements.

TABLE 2

| Electric resistance (kΩ) | Frequency of transition (index) DIS | DLI |
|---|---|---|
| 5.00 | 63.5 | 100 |
| 7.50 | 45.8 | 70 |
| 10.00 | 30.6 | 50 |
| 12.50 | | 40 |
| 15.00 | | 35 |
| 20.00 | | 32 |
| 22.50 | | 30 |
| 25.00 | | 28 |
| 27.50 | | 26 |
| 30.00 | | 24 |

As seen from FIG. 8, even when the DLI system is employed, the frequency of transition from glow discharge to arc discharge decreases with the electric resistance $R_k$. At an electric resistance $R_k$ of not less than 10 kΩ, the frequency of transition is suppressed as low as that in the case of the DIS system. Notably, at an electric resistance $R_k$ of not less than 20 kΩ, a decrease in the frequency of transition becomes gradual.

Figure 9:
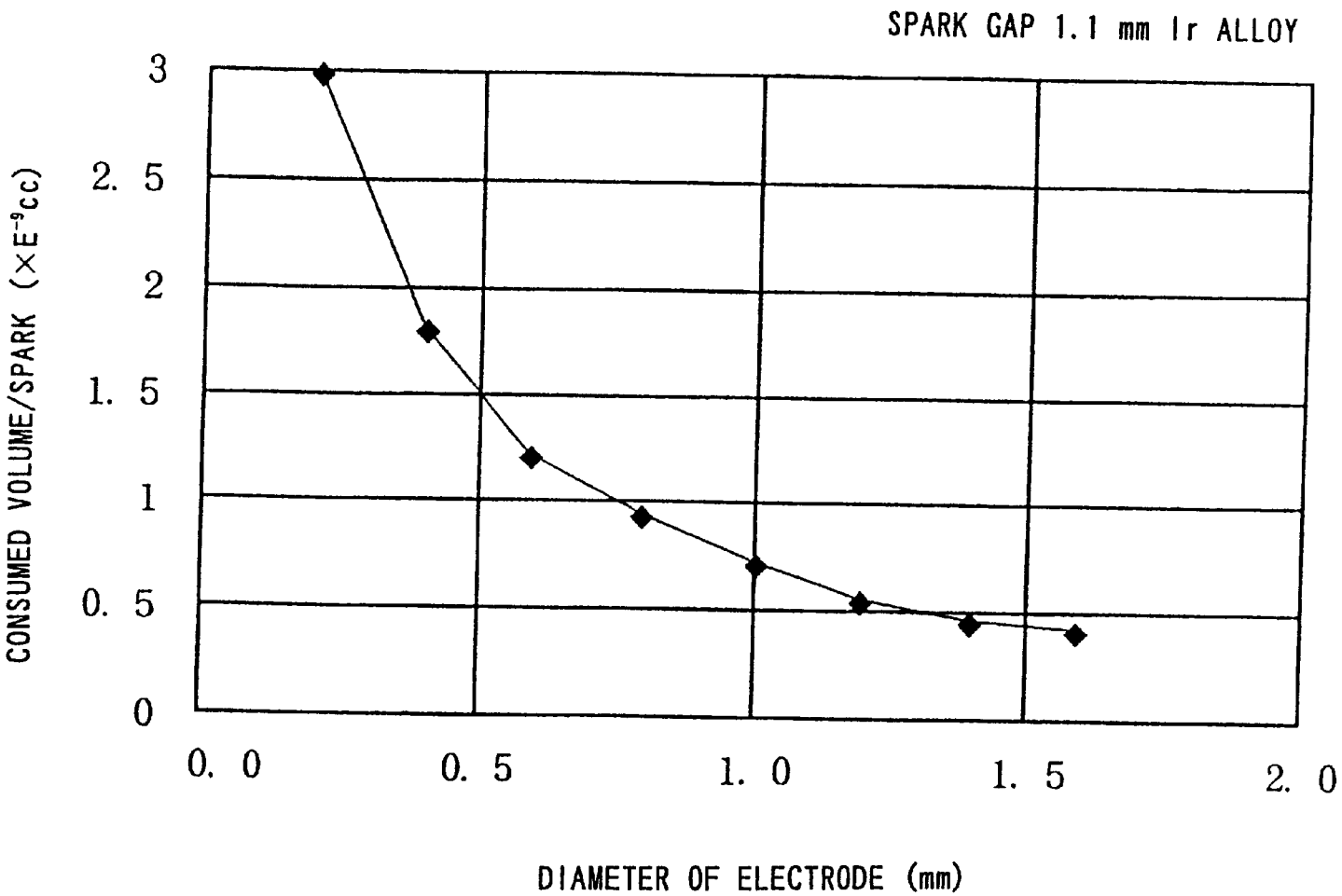
FIG. 9 is a graph showing the relationship between a consumed volume of an electrode and an electrode diameter.
Figure 10:
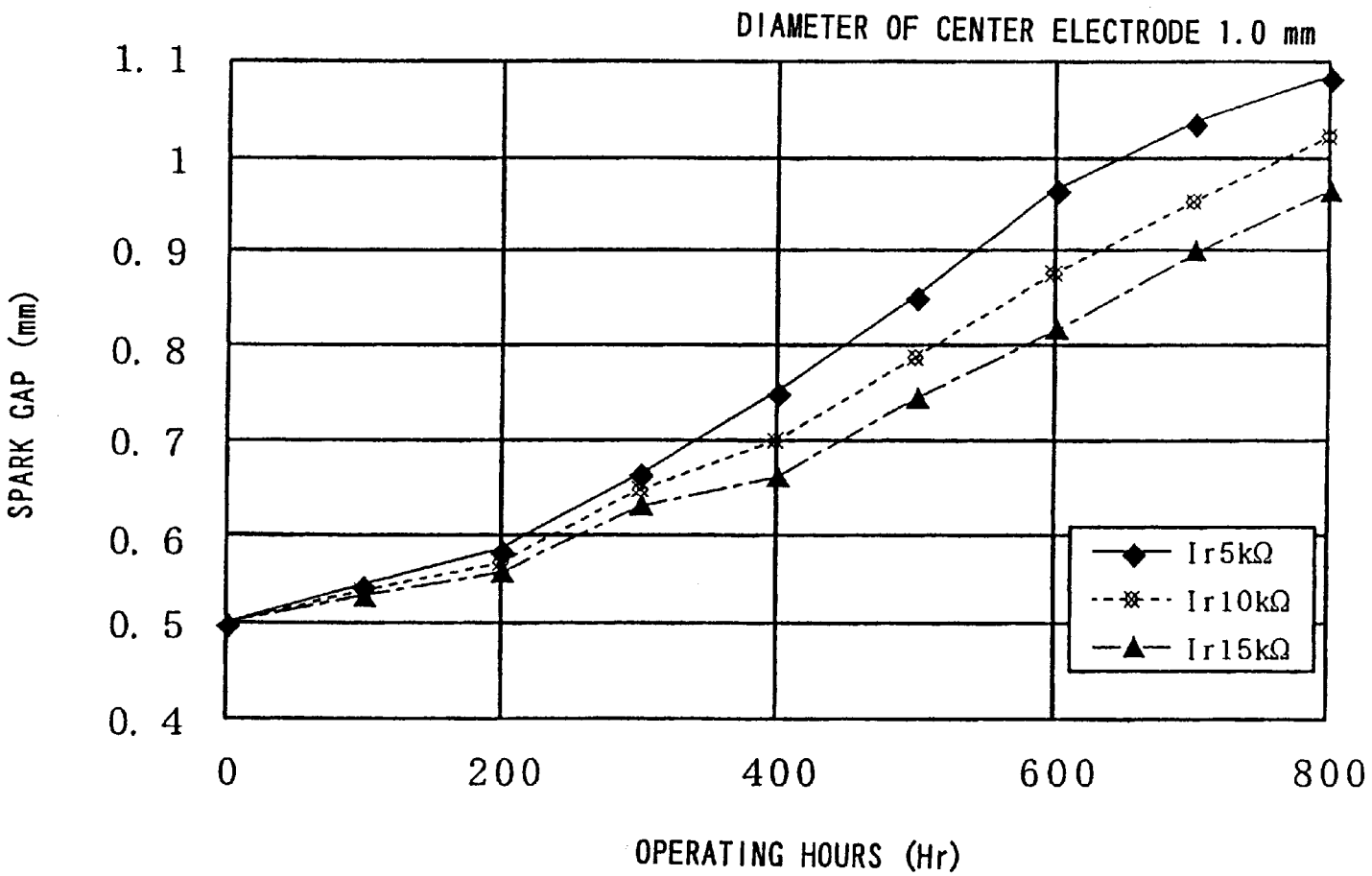
FIG. 10 is a graph showing the behavior of gap increase with operating hours.

FIG. 9 shows a consumed volume of a center electrode per spark as measured with respect to spark plugs having various values of end diameter δ of the center electrode after a continuous test operation of 800 hours was completed. This test employed an initial spark discharge gap γ of 1.1 mm and an electric resistance $R_k$ of 5 kΩ. As seen from FIG. 9, an electrode of a smaller diameter is consumed more per spark. Conceivably, this is because an electrode of a smaller diameter increases in temperature more readily and is thus more susceptible to temperature increase effected by glow-to-arc transition. FIG. 10 shows the behavior of gap increase with operating hours (up to 800 hours) as measured with respect to an electric resistance $R_k$ of 5 kΩ, 10 kΩ, and 15 kΩ. This test employed an initial spark discharge gap γ of 0.5 mm and an end diameter δ of 1.0 mm of the center electrode. As seen from FIG. 10, electrode consumption can be suppressed more effectively by increasing the electric resistance $R_k$ to 10 kΩ, and this effect is enhanced by increasing the electric resistance $R_k$ to 15 kΩ.

Figure 13:
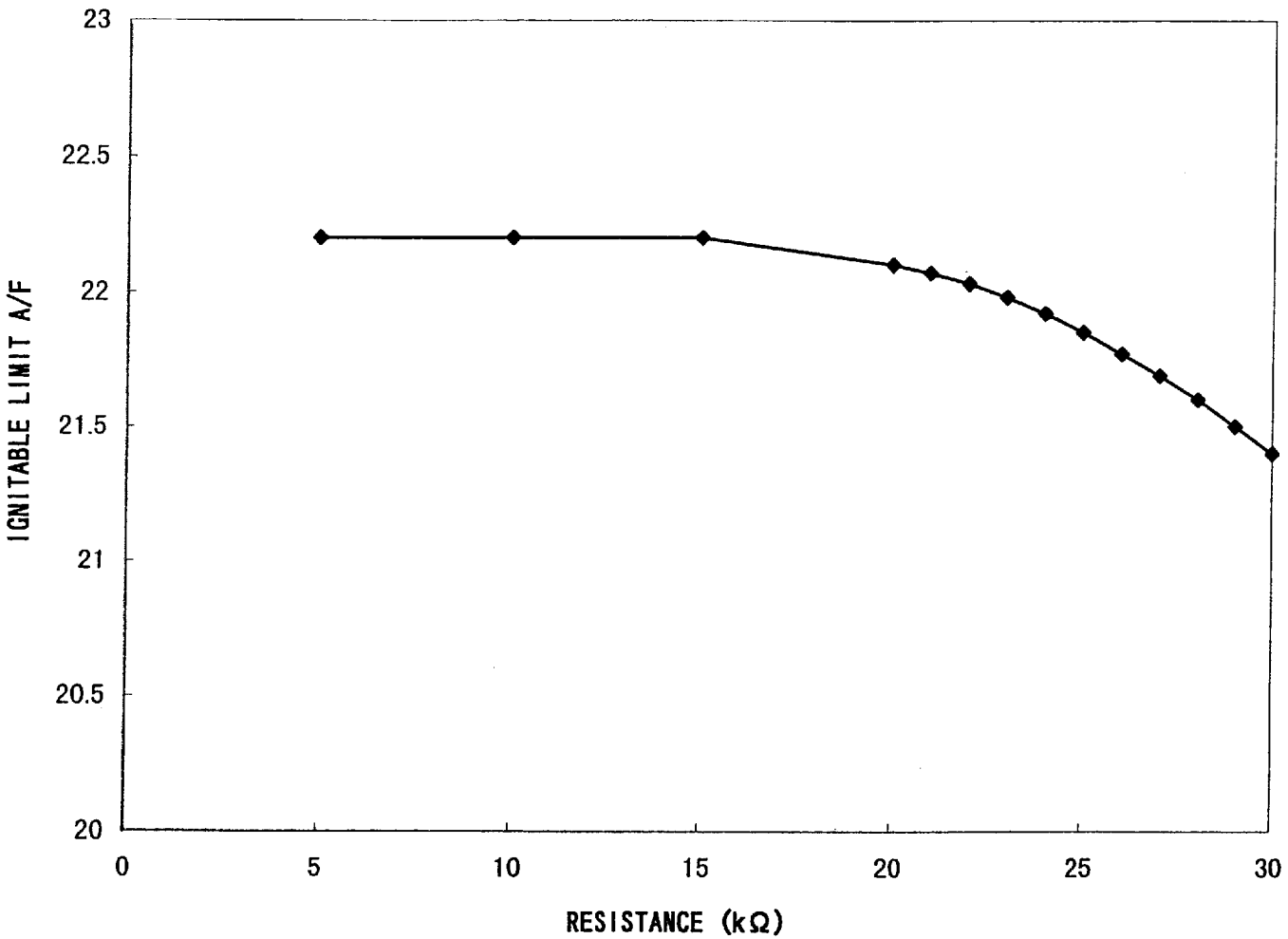
FIG. 13 is a graph showing the relationship between resistance and ignitable limit.

FIG. 13 is a graph showing the results of a test performed in order to evaluate the ignitability of spark plug samples each manufactured in such a manner that the spark discharge gap γ was set to 0.8 mm., the end diameter δ of the center electrode was set to 0.8 mm. and the electric resistance $R_x$ was set to a value in the range of 10 kΩ to 30 kΩ (the values are shown in Table 3). The spark plug samples were mounted on a 6 cylinder gasoline engine of a DOHC lean-burn type (engine capacity 1998 cc). The engine was operated at a boost pressure of 350 mmHg and an engine speed of 2000 rpm (corresponding to a driving speed of 60 km/h) while the air-fuel ratio was changed. An air-fuel ratio at the time when misfire reached 1% was measured as an ignitable limit.

TABLE 3

| Resistance | Air-fuel ratio (A/F) |
|---|---|
| 10 | 22.2 |
| 15 | 22.2 |
| 20 | 22.1 |
| 21 | 22.07 |
| 22 | 22.03 |

TABLE 3-continued

| Resistance | Air-fuel ratio (A/F) |
|---|---|
| 23 | 21.98 |
| 24 | 21.92 |
| 25 | 21.85 |
| 26 | 21.77 |
| 27 | 21.69 |
| 28 | 21.6 |
| 29 | 21.5 |
| 30 | 21.4 |

From the test results, it is understood that when the resistance becomes equal to or greater than 20 kΩ, the ignitable limit gradually decreases (it becomes impossible to ignite fuel unless the air-fuel ratio is increased) and that the ignitable limit starts to sharply decrease when the resistance exceeds 25 kΩ.

Obviously, numerous modifications and variations of the present invention are possible in light of the above teachings. It is therefore to be understood that within the scope of the appended claims, the present invention may be practiced otherwise than as specifically described herein.

What is claimed is:

1. A spark plug comprising:

a center electrode;

an insulator surrounding said center electrode;

a metallic shell surrounding said insulator;

a ground electrode facing said center electrode;

a spark portion which is fixedly attached to at least one of said center electrode and said ground electrode to thereby define a spark discharge gap, said spark portion being formed from a metal which contains not less than 60% by weight Ir;

a metallic terminal fixedly attached into one end portion of a through-hole formed axially in said insulator, said center electrode being fixedly attached into the other end portion of the through-hole; and a resistor disposed within the through-hole and between said metallic terminal and said center electrode, said resistor having an electric resistance of not less than 10 kΩ but not greater than 25 kΩ.

2. A spark plug according to claim 1 wherein the electric resistance between said metallic terminal and said center electrode is not less than 15 kΩ.

3. A spark plug according to claim 1 wherein said spark portion is formed at an end portion of said center electrode, and the diameter of the end portion of said center electrode is not greater than 1.1 mm.

4. A spark plug according to claim 3 wherein the diameter of the end portion of said center electrode is adjusted to 0.3 mm to 0.8 mm.

5. A spark plug according to claim 1 wherein the spark discharge gap is not greater than 1.2 mm.

6. A spark plug according to claim 5 wherein the spark discharge gap is not greater than 0.8 mm.

7. A spark plug according to claim 1 wherein said spark portion is formed from a metal which contains Ir as a main component and Rh in an amount of 3% by weight to less than 50% by weight.

8. A spark plug according to claim 7 wherein the material of said spark portion contains an oxide or composite oxide of a metallic element belonging to group 3A or group 4A of the periodic table in an amount of 0.1% by weight to 15% by weight.

9. A spark plug according to claim 1 wherein said spark portion is formed from a metal which contains Ir as a main component and Pt in an amount of 1% by weight to 20% by weight.

10. A spark plug according to claim 9 wherein the material of said spark portion contains an oxide or composite oxide of a metallic element belonging to group 3A or group 4A of the periodic table in an amount of 0.1% by weight to 15% by weight.

11. A spark plug according to claim 1 wherein the material of said spark portion contains an oxide or composite oxide of a metallic element belonging to group 3A or group 4A of the periodic table in an amount of 0.1% by weight to 15% by weight.

12. An ignition system for use with an internal combustion engine comprising:

a spark plug having a center electrode, an insulator surrounding the center electrode, a metallic shell surrounding the insulator, a ground electrode facing the center electrode, a spark portion which is fixedly attached to at least one of the center electrode and the ground electrode to define a spark discharge and which is formed from a metal which contains not less than 60% by weight Ir, and a metallic terminal fixedly attached into one end portion of a through-hole formed axially in the insulator, the center electrode being fixedly attached into the other end portion of the through-hole;

a coil unit having a casing attached to said spark plug, an ignition coil accommodated within said casing and connected to the metallic terminal of said spark plug in order to apply a high voltage to said spark plug for effecting an electrical discharge; and a resistance portion disposed between the ignition coil and the center electrode establishing an electric resistance of not less than 10 kΩ but not greater than 25 kΩ between the ignition coil and the center electrode.

13. An ignition system for use with an internal combustion engine according to claim 12 wherein said resistance portion establishes an electrical resistance of not less than 15 kΩ between the ignition coil and the center electrode.

14. An ignition system according to claim 12 wherein said spark portion is formed from a metal which contains Ir as a main component and Rh in an amount of 3% by weight to less than 50% by weight.

15. An ignition system according to claim 12 wherein said spark portion is formed from a metal which contains Ir as a main component and Pt in an amount of 1% by weight to 20% by weight.

16. An ignition system according to claim 12 wherein the material of said spark portion contains an oxide or composite oxide of a metallic element belonging to group 3A or group 4A of the periodic table in an amount of 0.1% by weight to 15% by weight.

17. An ignition system according to claim 14 wherein the material of said spark portion contains an oxide or composite oxide of a metallic element belonging to group 3A or group 4A of the periodic table in an amount of 0.1% by weight to 15% by weight.

18. An ignition system according to claim 15 wherein the material of said spark portion contains an oxide or composite oxide of a metallic element belonging to group 3A or group 4A of the periodic table in an amount of 0.1% by weight to 15% by weight.

* * * * *